US005382181A

United States Patent [19]

Ortiz

[11] Patent Number: 5,382,181

[45] **Date of Patent: * Jan. 17, 1995**

[54] LIGHTING SYSTEM

[75] Inventor: Jose A. Ortiz, Paterson, N.J.

[73] Assignee: John Tirado, Paterson, N.J.

[ * ] Notice: The portion of the term of this patent subsequent to Dec. 15, 2009 has been disclaimed.

[21] Appl. No.: 877,720

[22] Filed: May 4, 1992

Related U.S. Application Data

[63] Continuation-in-part of Ser. No. 769,722, Oct. 2, 1991, Pat. No. 5,171,292.

[51] Int. Cl.[6] ..... H01R 31/06

[52] U.S. Cl. ..... 439/628; 439/645

[58] Field of Search ..... 439/253–257, 439/628, 645

[56] References Cited

U.S. PATENT DOCUMENTS

| | | | |
|---|---|---|---|
| 1,702,135 | 2/1929 | Sawers et al. | 439/645 |
| 2,056,502 | 10/1936 | Borell | 439/645 |
| 5,006,751 | 4/1991 | Marshall | 439/628 |

*Primary Examiner*—Daniel W. Howell
*Attorney, Agent, or Firm*—Siegmar Silber

[57] ABSTRACT

A light bulb mounting arrangement has at least one continuous grooved indentation about the base portion and an adapter to fit the device to present day threaded sockets. The bulb is retained in a substantially tubular socket which is in a close fitting or telescopic relation with the base. The retaining mechanism has at least two spring-loaded fingers having nodes thereon with cross-sectional profiles similar to and matable with those of the grooved indentions. Optionally, the adapter upon installation is captive within the existing conventional socket.

16 Claims, 3 Drawing Sheets

LIGHTING SYSTEM

CROSS-REFERENCES TO RELATED APPLICATION

This application is a continuation-in-part of co-pending application entitled Light Bulb and Mounting Arrangement Therefor bearing. The within application and U.S. patent application Ser. No. 07/769,722, filed Oct. 2, 1991 are of common ownership and inventorship and the terminal portion of the term hereof is disclaimed so that the patent(s) issuing thereon are co-terminus.

BACKGROUND OF THE INVENTION

1. Field of the Invention

This invention relates to a lighting system with an adapter, a light bulb and a mounting arrangement therefor, and more particularly to a light bulb which is readily mounted by translation without rotation along the longitudinal axis thereof. In one embodiment, the adapter is designed, upon first installation, to remain captive in the threaded base. Thereafter, long-life bulbs with the unusual base hereof may be used in public accommodations without re-usability at locations lacking the adapter.

2. Information Disclosure Statement

In preparing for the related co-pending application, a pre-examination patentability search was conducted. As a result of the search, the following patents are disclosed:

| ITEM NO. | U.S. Pat. No. | INVENTOR | ISSUE DATE |
|---|---|---|---|
| 1 | 271,171 | Edward Weston | 01/23/1883 |
| 2 | 3,215,972 | E. A. Eriksson | 11/02/1965 |
| 3 | 3,253,249 | L. J. Hess et al. | 05/24/1966 |
| 4 | 4,886,994 | Albert J. Ragge, Jr. | 12/12/1989 |

U.S. Pat. No. 271,171—E. Weston—U.S. Electric Lighting

Shows technology prior to the modern clear division between the base and socket functions. Discloses lumps of metal for contact points and springs for electrical connection. Bulb is a gravity-held, cup-supported structure.

U.S. Pat. No. 3,215,972—E. A. Eriksson

Shows a spring clip integrally formed with the base, and includes various clip arrangements designed for this function.

U.S. Pat. No. 3,253,249—L. J. Hess et al.—Republic Ind. Corp.

Shows a baseless bulb with dimples or recesses.

U.S. Pat. No. 4,886,994—A. J. Ragge

Shows a snap-in light bulb which attaches a metal spring clip to the base of a bulb to convert a standard threaded bulb to a plug-in unit for a threaded socket. No attempt is made to change the socket parameters for snap-in use.

In the course of examining the co-pending application, an Examiner's search was conducted. As a result thereof, the following patents are disclosed:

| U.S. PATENT DOCUMENTS | | | |
|---|---|---|---|
| Item No. | U.S. Pat. No. | Inventor | Date |
| A | 1,104,577 | G. B. Thomas | 07/21/1914 |
| B | 2,071,769 | H. C. Schlicker et al | 02/23/1937 |
| C | 3,056,941 | E. A. Eriksson | 10/02/1962 |

-continued

| | | | |
|---|---|---|---|
| D | 3,101,984 | G. Wieckmann | 08/27/1963 |

| FOREIGN PATENT DOCUMENTS | | | |
|---|---|---|---|
| Item No. | Country | Inventor | Date |
| L | Germany | X. Bullinger | 05/1927 |
| M | Italy | J. C. a Parigi | 01/1959 |
| N | Canada | Pinces | 08/1965 |
| O | Japan | M. Denko | 04/1979 |

The patent to Bullinger, Foreign Patent Document Reference L, shows a lamp with a threaded base mounted in a socket with a single wire contacting the base. The lamp is spring mounted so that the central contact post rides on a coilspring-mounted isolation block.

Denko, Foreign Patent Document Reference O, shows a socket designed for a threaded lamp base in which a lock pawl extends into the lamp socket cavity. The spring action of pawl permits insertion of a standard threaded bulb. The bulb is removed by unscrewing as is normally done in conventional devices.

The patent to Schlicker et al. '769 shows a lamp socket for a bulb with a threaded base. Fingers that extend from the socket base of Schlicker et al. '769 have projections that contact the innermost portion of the bulb-base thread.

The patent to Thomas '577 shows a receptacle for a threaded plug. The lugs are staggered about the circumference so as to make intimate contact with the threads of the plug.

Patent references C, D, M, and N were not applied by the examiner, but are cited here for disclosure purposes only.

SUMMARY

In general terms, the invention disclosed hereby is a light bulb mounting arrangement which includes at least one continuous grooved indentation about the base portion and an adapter to fit the device to present-day threaded sockets. The bulb is retained in a substantially tubular socket which is in a close fitting or telescopic relation with the base. The retaining mechanism has at least two spring-loaded fingers having nodes thereon with cross-sectional profiles similar to and matable with those of the grooved indentions. Optionally, the adapter upon installation is captive within the existing conventional socket.

OBJECTS AND FEATURES OF THE INVENTION

It is an object of the present invention to provide an lighting system with a light bulb and an adapter arrangement.

It is a further object of the present invention to provide a light bulb that is mountable into the adapter and socket by translation along the axis thereof without regard to radial alignment.

It is another object of the present invention to provide a secure mounting of a light bulb in which the envelope thereof will not separate from the base during retraction from the socket.

It is still yet another object of the present invention to provide a balanced mounting arrangement for a new light bulb hereof into a conventional socket.

It is a feature of the present invention that in one embodiment of the adapter hereof, the adapter can be easily installed and cannot be removed withiout virtually destroying the fixture.

It is another feature of the present invention to have a balanced tension on all sides of the base and thereby enhancing vibration resistance of the bulb and extending bulb life.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENT

Figure 1:
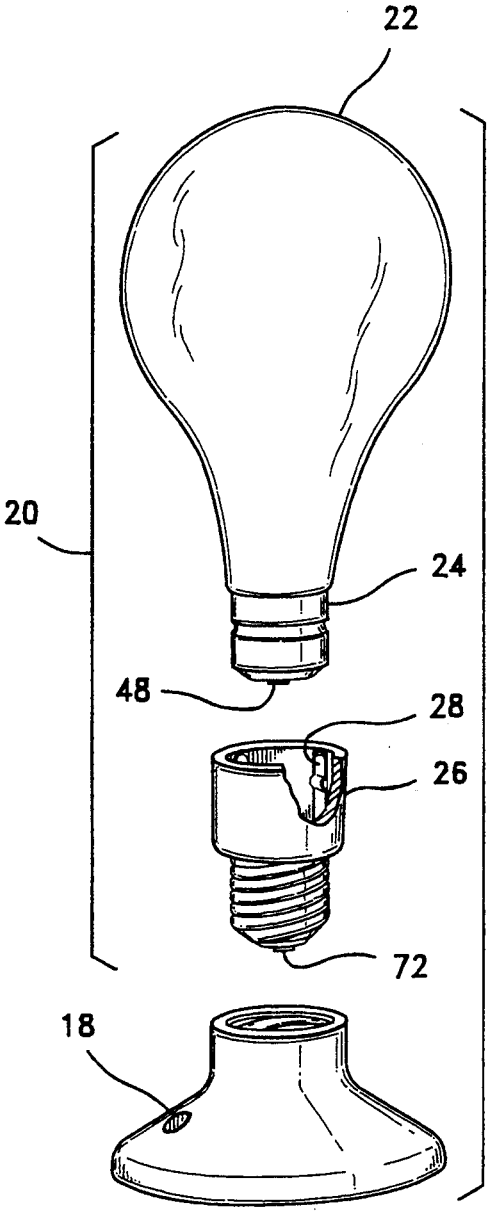
FIG. 1 is a perspective view of a lighting system of the present invention, shown with the adapter socket broken away and shown in relation to a prior art, threaded socket base.
Figure 2:
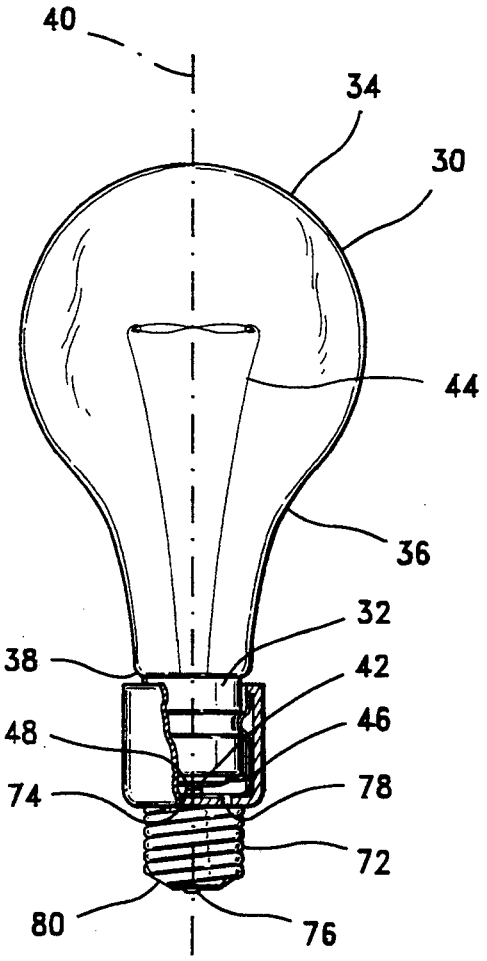
FIG. 2 is a front elevational view of the invention shown in FIG. 1, shown with a portion of the socket broken away to illustrate the dimensional relationships with the bulb installed.
Figure 3:
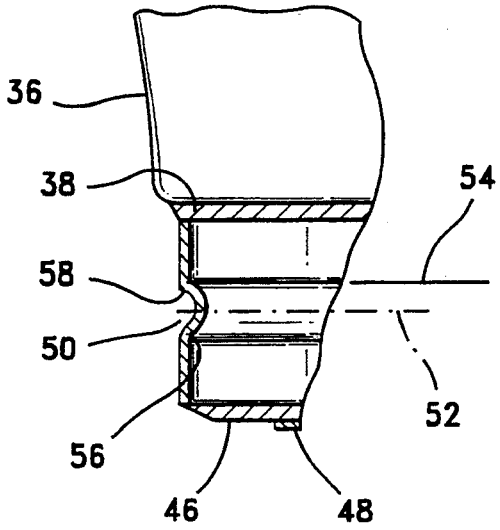
FIG. 3 is a partial cross-sectional view of the invention of FIG. 1 showing details of the retaining groove of the bulb.

Referring to FIGS. 1, 2 and 3 a light bulb and adapter socket system generally referred to by the numeral 20, is shown. The lighting system 20 includes a bulb 22 with a non-threaded base 24 and an adapter socket 26 with a spring retainer 28. The lighting system 20 is shown in FIG. 1 juxtaposed with a socket for a threaded base 18, which base is a prior art device. The exterior of the bulb 22, as seen in greater detail in FIG. 2 is defined by a globe 30 and a substantially cylindrical wall 32 of base 24. The wall 32 is constructed of a conductive material such as the brass, copper or other metal alloy common to the conventional threaded bulb. The globe 30 is constructed with an upper substantially spherical envelope or dome 34 and a lower tapered neck portion 36 which is dimensioned to mate with the throat 38 of base wall 32. Although the terms "upper" and "lower" are used these terms are merely for ease of description and are descriptive of the drawings; however, such terms do not limit the position of the bulb during operation. Further and also for descriptive purposes, the bulb has a longitudinal axis 40 extending from the top of the dome 34, coincident with and along the longitudinal axis of the cylindrical base wall 32, and to the center of the bottom 42 of the bulb 22. The bulb 22 is structured to include a lamp element 44 extending from the bottom center 42 inwardly into the interior of the globe 30. The bulb 22 has an insulating portion or plate 46 in which an electrically conductive portion or terminal 48 is centrally located. The insulating plate 46 is substantially frustoconical in form and with terminal 48 closes the bottom of the base wall 32 to provide a sealed unit. During operation, base wall 32 and terminal 48 electrically connect element 44 to power supplied. About the base 32 is a retaining groove 50 which is uniquely profiled for the application at hand and developed especially therefor. The centerline 52 of groove 50 lies in a plane 54 normal to the longitudinal axis 40. The distance along the longitudinal axis 40 between the plane 54 and bottom of terminal 48 is selected so that when during operation the bulb 22 is inserted in and retained by the adaptive socket 26, the terminal 48 reaches a fixed position with respect thereto. The retaining groove 50 has a profile best seen in the cross-sectional view of FIG. 3. Here the portion of the groove 50 closest to the bottom center 42 or terminal 48 has a radius permitting the spring retainer, described hereinbelow, to be guided thereover. This radius defines an entry throat portion 56. Further, the portion of the groove 50 closest to the dome 34 has a radius stopping the movement of spring retainer, described hereinbelow. This radius defines a travel limit portion 58. The inside of the groove 50 is smoothly curved in both the radial and axial aspects thereof.

Figure 4:
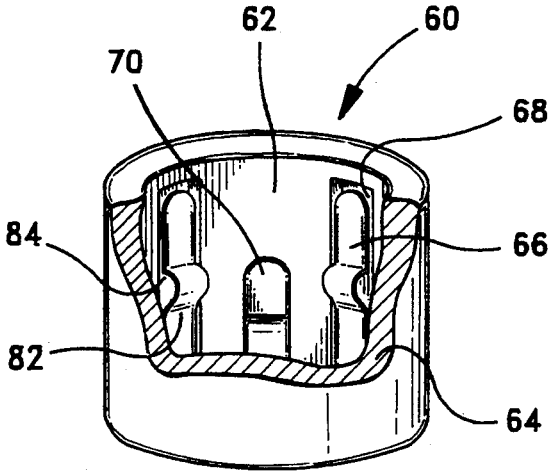
FIG. 4 is a partial perspective view of the invention of FIG. 1 broken away to show the adapter socket and retainer spring.

Turning now to FIG. 4 the adapter socket 26 is next described. The adapter socket 26 is constructed from an insulative plastic composite or ceramic, the unit may be structured from almost any acceptable material that provides the degree of insulation required. The socket includes a receptacle 60 with an opening or cavity 62 to receive the substantially cylindrical base wall 32 of the bulb. The wall 32 and substantially cylindrical wall 64 of socket 26 are close in tolerance so that the bulb may be easily slid into and be readily spring retained thereby without significant side-to-side play. The socket has a crown-shaped retainer spring 66 constructed to seat at the bottom of the socket cavity and having portions arising therefrom that are housed in retainer spring grooves 68. The grooves 68 are designed to extend upward from the floor of the cavity 62 so that only the convex spring portions, described in detail hereinbelow, extend into cavity 62. For this embodiment, the retainer spring 66 has three spring arms 70 for extension into groove 50. The arms 70 are positioned about the longitudinal axis at 0°, 20°, and 240°. Further, the arms 70 are designed so that, upon extension into the groove, the spring arms 70 assume substantially the same profile as groove 50 and thereby have a sizable contact area with the bulb base. The socket 26 has at least two electrically connective portions at the base thereof. One forms an electrical pathway from socket base 72 to terminal 48 of bulb 22 through spring electrical contact portion 74 and downward through the central portion of the adapter socket 26 base to terminal 76. The other forms an electrical pathway from socket base 72 to bulb base 24 through electrical lead 78. The electrical lead 78 interconnects with the lower threaded portion 80 and the retainer spring 66. The lead 78 is structured to be well-isolated from contact portion 74 in a manner to preclude occurrence of short circuits. The spring arms 70 are next described in greater detail. Each spring arm 70 has a profile best seen in the cross-sectional view of FIG. 4.

Here the portion of the spring arm 70 closest to the spring contact portion 74 has a radius or convex portion 82 corresponding and opposite that of entry throat portion 56 of retaining groove 50. Further, the stop portion 84 of the spring arm 70 corresponds with travel limit portion 58 of retaining groove 50. With the interrelationship of retaining groove 50 and spring arm 70 just described certain structural aspects are further delineated. Spring arm 70 is designed so that force required to remove the bulb from the socket base 72 is far greater than the force exerted on terminal 48 by spring electrical contact portion 74.

Figure 5:
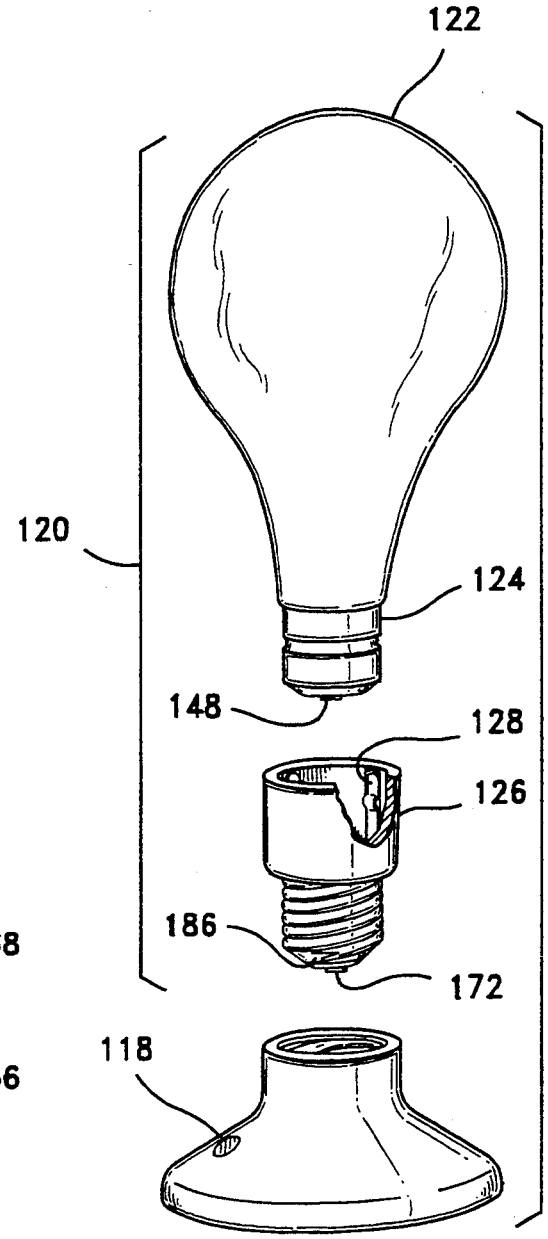
FIG. 5 is a perspective view of a second embodiment of a lighting system of the present invention, shown with the adapter socket broken away and shown in relation to a prior art, threaded socket base.
Figure 6:
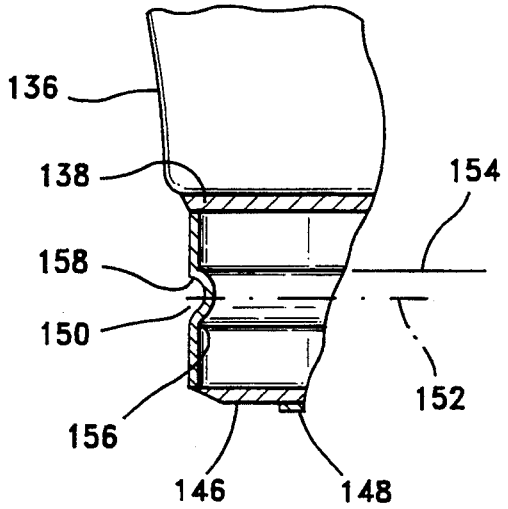
FIG. 6 is a partial cross-sectional view of the invention of FIG. 5 showing details of the retaining groove of the bulb.
Figure 8:
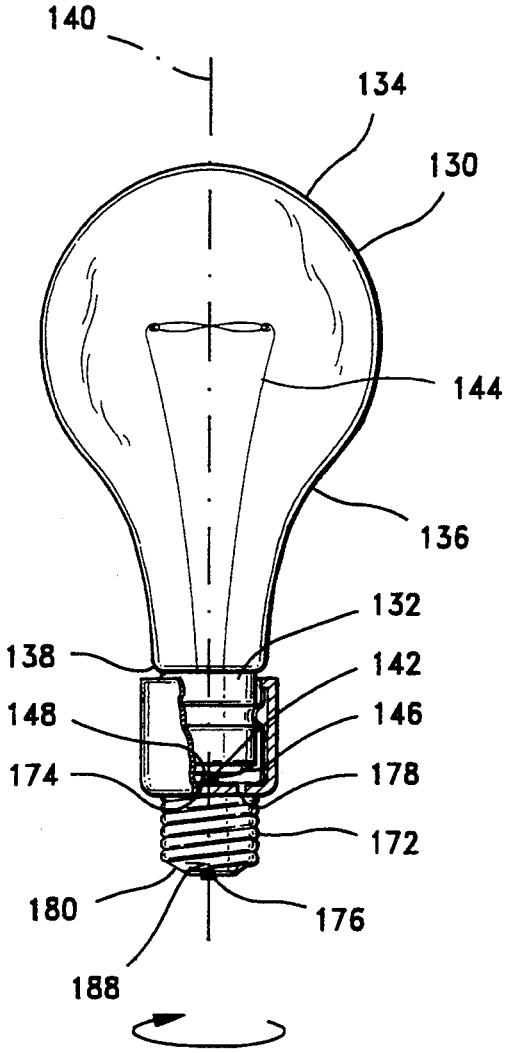
Figure 7:
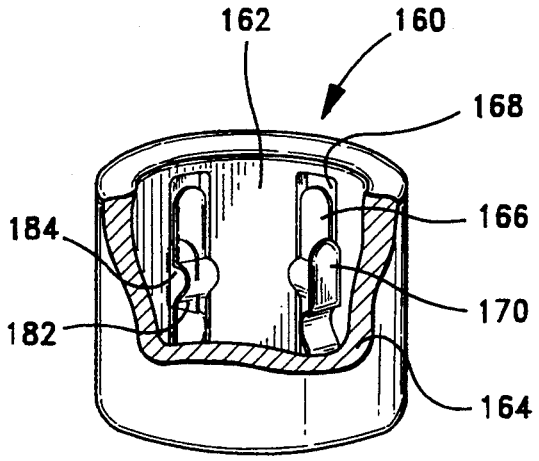
FIG. 7 is a partial perspective view of the invention of FIG. 5 broken away to show the adapter socket and retainer spring; and, FIG. 8 is a front elevational view of the invention shown in FIG. 5, shown with a portion of the socket broken away to illustrate the dimensional relationships with the bulb installed and the securing device for "one-way" adapter installation.

Turning now to the second embodiment of the present invention, reference is made to FIGS. 5, 6, and 7 showing a light bulb and socket system generally referred to by the numeral 120. In further embodiments of the invention, for convenience similar parts shown in the additional drawings carry reference designators "100" units higher in the second embodiment. For example, the retaining groove 50 of the first embodiment finds an analogous groove 150 in the second embodiment. The system 120 includes a bulb 122 with a non-threaded base 124 and a adapter socket 126 with a spring retainer 128. The exterior of the bulb 122, as seen in greater detail in FIG. 8 is defined by a globe 130 and a substantially cylindrical wall 132 of base 124. The wall 132 is constructed of a conductive material such as the brass, copper or other metal alloy common to the conventional threaded bulb. The globe 130 is constructed with an upper substantially spherical envelope or dome 134 and a lower tapered neck portion 136 which is dimensioned to mate with the throat 138 of base wall 132. In contrast to the first embodiment, the bulb 122 is larger in scale and is of heavier construction, such as is frequently referred to as a "mogul" type base. The bulb has a longitudinal axis 140 extending from the top of the dome 134, coincident with and along the longitudinal axis of the cylindrical base wall 132, and to the center of the bottom 142 of the bulb 122. The bulb 122 is structured to include a lamp element 144 extending from the bottom center 142 in to the interior of the globe 130. The bulb 122 has an insulating portion or plate 146 in which an electrically conductive portion or terminal 148 is centrally located. The insulating plate 146 is substantially frustoconical in form and with terminal 148 closes the bottom of the base wall 132 to provide a sealed unit. During operation, base wall 132 and terminal 148 electrically connect element 144 to power supplied. About the base 132 is a retaining groove 150 which is uniquely profiled for the application at hand and developed especially therefor. The centerline 152 of groove 150 lies in a plane 154 normal to the longitudinal axis 140. The distance along the longitudinal axis 140 between the plane 154 and bottom of terminal 148 is selected so that when during operation the bulb 122 is inserted in and retained by socket 126, the terminal 148 reaches a fixed position with respect thereto. The retaining groove 150 has a profile best seen in the cross-sectional view of FIG. 6. Here the portion of the groove 150 closest to the bottom center 142 or terminal 148 has a radius permitting the spring retainer, described hereinbelow, to be guided thereover. This radius defines an entry throat portion 156 of retaining groove 150. Further, the portion of the groove 150 closest to the dome 134 has a radius stopping the movement of spring retainer, described hereinbelow. This radius defines a travel limit portion 158, which, because of the scale of the mogul-type bulb 122, is more clearly delineated as to the mechanical travel limiting function. The inside of the groove 150 is smoothly curved in both the radial and axial aspects thereof.

Turning now to FIG. 7 a socket 126 is next described. While the socket 126 of the second embodiment includes a receptacle 160 with an opening 162 to receive the substantially cylindrical base wall 132. The wall 132 and substantially cylindrical wall 164 of socket 126 are close in tolerance so that the bulb may be easily slid into and be readily spring retained thereby without significant side-to-side play. The socket has a crown-shaped retainer spring 166 constructed to seat at the bottom of the socket cavity and having portions arising therefrom that snap into retainer spring groove 168. For this embodiment, the retainer spring 166 has four spring arms 170 for extension into groove 150. The arms 170 are positioned about the longitudinal axis at 0°, 90°, 180°, and 270°. Further, the arms 170 are designed so that, upon extension into the groove, the spring arms 170 assume substantially the same profile as groove 150 and thereby have a sizable contact area with the bulb base. The socket 126 has at least two electrically connective portions at the base thereof. One forms an electrical pathway from socket base 172 to terminal 148 of bulb 122 through spring electrical contact portion 174 and downward through the central portion of the adapter socket 126 to terminal 176. The other forms an electrical pathway from socket base 172 to bulb base 124 through electrical lead 178. The electrical lead 178 interconnects with lower threaded portion 180 and the base of crown-shaped retainer spring 166. The lead 178 is structured to be well-isolated from contact portion 174 in a manner to preclude occurrence of short circuits. The spring arms 170 are next described in greater detail. Each spring arm 170 has a profile best seen in the cross-sectional view of FIG. 7. Here the portion of the spring arm 170 closest to the spring contact portion 174 has a convex portion 182 corresponding and opposite that of entry throat portion 156 of retaining groove 150. Further, the stop portion 184 of the spring arm 170 corresponds with travel limit portion 158 of retaining groove 150. With the interrelationship of retaining groove 150 and spring arm 170 just described certain structural aspects are further delineated. Spring arm 170 is designed so that force required to remove the bulb from the socket base 172 is far greater than the force exerted on terminal 148 by spring electrical contact portion 174. In the second embodiment, a locking device 186, FIG. 5, is mounted on lower threaded portion 180, FIG. 8, for precluding removal of the adapter socket 126 from the prior art threaded socket base.

In the best mode of practicing the present invention, the lock device 186, FIG. 5, is a spike 188 with one end thereof to the thread of the threaded adapter socket 126 such that the spike 188 inserts radily as the adapter portion is threadedly installed, but resists adapter socket 126 removal.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A lighting system including an electric light bulb and an adapter socket arrangement, said bulb with a globe sealed to a metal alloy bulb base, with a central insulated terminal in said bulb base, and with a lamp filament connected across said bulb base and said insulated terminal, said system comprising, in combination:

a bulb with a substantially cylindrical wall at said base thereof;

groove means for securing said bulb extending into and about said bulb base with the centerline thereof lying within a plane normal to the longitudinal axis of said bulb, said groove means having a throat portion with a gradual sloping entry and a shoulder portion with a radius defining a travel limit;

a socket arrangement, in turn, comprising:

a socket base portion at one end of said socket arrangement with an open cavity therein and a substantially cylindrical wall dimensioned to slidably engage said bulb base;

an adapter portion at the end opposite said base portion, said adapter portion having a metal alloy threaded adapter base and providing electrical connection therethrough from a threaded socket base to said socket base portion;

retaining spring means for retaining said bulb, said retaining spring means in the wall of said base portion with a plurality of lug portions of said retaining spring means extending into said cavity of said socket base;

spring terminal means for electrical connection to the bottom of said bulb base; and, said plurality of lug portions of said retaining spring means dimensioned to, upon the bulb insertion into the receptacle, seat within said groove means, said plurality of lug portions being equally spaced about the groove means and exerting balanced spring pressure on the bulb to retain the bulb in the socket;

whereby the insertion of the bulb into the socket is by axial movement without orientation and without rotation thereof.

2. A lighting system as described in claim 1 wherein said plurality of lug portions, upon insertion of said bulb in said socket substantially conform to the profile of said groove and provide the spring tension for said bulb retention.

3. A lighting system as described in claim 2 wherein said retaining spring means in turn further comprises:

a spring base having a cup-like shape and dimensioned to seat in said cavity at the end opposite the opening thereinto;

a plurality of finger portions extending from said spring lease engaging said socket base without protruding into said cavity; and, a plurality of lug portions, each said lug portion extending from one of said finger portions into said cavity for engagement with said groove.

4. A lighting system as described in claim 3 wherein said lug portions further comprise three lugs radially spaced about said longitudinal axis at 0°, 120° and 240°.

5. A lighting system as described in claim 3 wherein said lug portions further comprises four lugs radially spaced about said longitudinal axis at 0°, 90°, 180° and 270°.

6. A lighting system as described in claim 1 wherein said adapter portion in turn further comprises:

a second central insulated terminal in said adapter base for cooperative functioning with said bulb base and said socket base; and, lock means for precluding removal of said adapter portion from said threaded socket base, said lock means mounted on said threaded adapter base portion of said adapter portion.

7. A lighting system as described in claim 6, wherein said lock means is a spike with one end thereof attached to the thread of said threaded adapter base, said spike mounted to insert readily as the adapter portion is threadedly installed and mounted to resist adapter portion removal.

8. A lighting system as described in claim 6 wherein said big portions further comprise three lugs radially spaced about said longitudinal axis at 0°, 120° and 240°.

9. A lighting system as described in claim 6 wherein said lug portions further comprises four lugs radially spaced about said longitudinal axis at 0°, 90°, 180° and 270°.

10. A lighting system including an electric light bulb and an adapter socket arrangement, said bulb with a globe sealed to a metal alloy bulb base, with a central insulated terminal in said bulb base, and with a lamp filament connected across said bulb base and said insulated terminal, said system comprising, in combination:

a bulb with a substantially cylindrical wall at said base thereof;

groove means for securing said bulb extending into and about said bulb base with the centerline thereof lying within a plane normal to the longitudinal axis of said bulb;

a socket arrangement, in turn, comprising:

a socket base portion at one end of said socket arrangement with an open cavity therein and a substantially cylindrical wall dimensioned to slidably engage said bulb base;

an adapter portion at the end opposite said base portion, said adapter portion having a metal alloy threaded adapter base and providing electrical connection therethrough from a threaded socket base to said socket base portion;

retaining spring means for retaining said bulb, said retaining spring means in the wall of said base portion with a plurality of lug portions of said retaining spring means extending into said cavity of said socket base;

spring terminal means for electrical connection to the bottom of said bulb base; and, said plurality of lug portions of said retaining spring means dimensioned to, upon the bulb insertion into the receptacle with the spring terminal means slightly compressed, protrude into said groove means and to seat therewithin said plurality of lug portions being equally spaced about the groove means and exerting balanced spring pressure on the bulb to retain the bulb in the socket;

a second central insulated terminal in said adapter base for cooperative functioning with said bulb base and said socket base; and, lock means for precluding removal of said adapter portion from said threaded socket base, said lock means mounted on said threaded adapter base portion of said adapter portion;

whereby the insertion of the bulb into the socket is by axial movement without orientation and without rotation thereof.

11. A lighting system and as described in claim 10 wherein said groove further comprises a throat portion with a gradual sloping entry and a shoulder portion with a radius defining a travel limit.

12. A lighting system as described in claim 11 wherein said plurality of lug portions, upon insertion of said bulb in said socket substantially conform to the profile of said groove and provide the spring tension for said bulb retention.

13. A lighting system as described in claim 12 wherein said retaining spring means in turn further comprises:

a spring base having a cup-like shape and dimensioned to seat in said cavity at the end opposite the opening thereinto;

a plurality of finger portions extending from said spring lease engaging said socket base without protruding into said cavity; and, a plurality of lug portions, each said lug portion extending from one of said finger portions into said cavity for engagement with said groove.

14. A lighting system as described in claim 13 wherein said lug portions further comprise three lugs radially spaced about said longitudinal axis at 0°, 120° and 240°.

15. A lighting system as described in claim 14 wherein said lug portions further comprises four lugs radially spaced about said longitudinal axis at 0°, 90°, 180° and 270°.

16. A lighting system as described in claim 10, wherein said lock means is a spike with one end thereof attached to the thread of said threaded adapter base, said spike mounted to insert readily as the adapter portion is threadedly installed and mounted to resist adapter portion removal.

* * * * *